US005897763A

United States Patent [19]

Elligsen et al.

[11] Patent Number: 5,897,763

[45] Date of Patent: Apr. 27, 1999

[54] METHOD OF ELECTROPLATING GLARE-FREE NICKEL DEPOSITS

[75] Inventors: Carmen Elligsen, Grevenbroich; Gerd Schöngen, Baesweiler; Detlef Kowczyk, Essen, all of Germany

[73] Assignee: LPW-Chemie GmbH, Neuss, Germany

[21] Appl. No.: 08/736,906

[22] Filed: Oct. 25, 1996

[30] Foreign Application Priority Data

Oct. 27, 1995 [DE] Germany ..... 195 40 011

[51] Int. Cl.[6] ..... C25D 3/12

[52] U.S. Cl. ..... 205/271; 205/273; 205/274; 205/276

[58] Field of Search ..... 205/271, 273, 205/274, 276

[56] References Cited

U.S. PATENT DOCUMENTS

| | | | |
|---|---|---|---|
| 2,238,861 | 4/1941 | Lind et al. | 205/274 |
| 3,023,151 | 2/1962 | Strauss et al. | 205/277 |
| 3,839,165 | 10/1974 | Strauss et al. | 205/276 |
| 3,839,166 | 10/1974 | Michael | 205/276 |
| 3,865,702 | 2/1975 | Immel et al. | 205/273 |

FOREIGN PATENT DOCUMENTS

| | | |
|---|---|---|
| 1 621 085 | 3/1971 | Germany . |
| 23 27 881 | 1/1975 | Germany . |
| 56-152988 | 11/1981 | Japan . |
| 61-238993 | 10/1986 | Japan . |
| 62-205041 | 9/1987 | Japan . |

OTHER PUBLICATIONS

George DiBAri ("Nickel Plating", Metal Finishing, v. 82, In. 1A, Jan. 1984).

WPIDSabstract of JP 61238993 (Daiichi Kogyo), Oct. 24, 1986.

JAPIO abstract of JP61238993 (Daiichi Kogyo), Oct. 24, 1986.

WPIDS abstract of JP62205041 (Nisso Yuka), Sep. 9, 1987.

Abstract of JP56152988 (Koura N.), Nov. 26, 1981.

*Primary Examiner*—Kathryn L. Gorgos
*Assistant Examiner*—Alex Noguerola
*Attorney, Agent, or Firm*—Herbert Dubno

[57] ABSTRACT

A method of electrodepositing nickel and nickel alloys on a metal surface of a substrate wherein a Watts or other nickel deposition electrolyte is used as the bath in the presence of a conventional base brightener. According to the invention, an ethylene-oxide adduct or propylene-oxide adduct or ethyleneoxide/propylene-oxide adduct is added in an amount less than 5 mg/l and the deposition is carried out at 40 to 75° C. and the concentration of the adduct and the temperature are so selected that during operation and with visual inspection there is no cloudiness nor any diffuse scattering of light incident upon the bath.

24 Claims, 1 Drawing Sheet

METHOD OF ELECTROPLATING GLARE-FREE NICKEL DEPOSITS

FIELD OF THE INVENTION

Our present invention relates to a process for the electroplating of glare-free nickel deposits on a metal surface, the nickel deposit consisting of nickel or nickel alloys and the metallic surface being the surface of a metallic substrate or a metallic coating on a nonmetallic object.

BACKGROUND OF THE INVENTION

In a prior art process over which the invention represents an improvement and as described in German patent document DE 16 21 085 A1, a Watts electrolytic bath containing the usual brighteners (basic brighteners) can be used. A Watts electrolyte can be that described in the LPW "Taschenbuch für Galvanotechnik", Vol. 1, Verfahrenhstechnik, 13, issued 1988, (Pg. 173 to 177), i.e. Handbook for Electroplating, Process Technology. The process of the prior art for the production of glare-free coatings, utilizes substituted and/or unsubstituted ethylene-oxide adducts, propylene-oxide adducts or ethylene-oxide/propylene-oxide adducts with an adduct concentration of 5 to 100 mg/l and a temperature of the bath at 40 to 75° C. The adducts, under the conditions used heretofore formed a finely dispersed emulsion which appeared as cloudiness. The droplets of the emulsion were assumed to be the basis for the glare-free surface. However, the glare-free property can be improved.

The term "glare-free" is used here to characterize a surface of a nickel deposit which provides more or less of a satin-like brightness, i.e. a relatively bright finish but one which does not produce a dazzle effect.

It has been believed heretofore that such a satin-like bright nickel deposit requires the addition to the bath of nonionic surface-active agents which tend to precipitate out at high electrolyte temperatures. In that case, they form an organic contaminant in the electrolyte in the form of an emulsion. Of course not every optionally selectable nonionic surface-active agent can be used since the cloud point, i.e. the electrolyte temperature at which the surface-active agent precipitates, depends upon the chemical structure and the concentrations of the substances in the electrolyte. In addition, the salt contribution of the electrolyte is a determinant of the level of the cloud point. In spite of the more or less fine distribution of the emulsion droplets in this system, there is a danger that the emulsion droplets may ball up to produce relatively large conglomerates which can interfere with the satin-like character of the deposit. As a consequence, it has been necessary in the past to cool the electrolyte in a correspondingly dimensioned bypass circulation so that the cloud point of the nonionic surfactant will not be approached or exceeded and the nonionic surfactants will remain dissolved in the electrolyte. In addition, the electrolyte must be heated to the requisite working temperature. The process must be carried out with considerable care and monitoring to avoid the formation of black pores. Finally, the antiglare effect and the reproducibility are normally not sufficient and reliability of the process cannot be ensured.

It is known to utilize a variety of foreign substances in the electrolyte bath (see DE 23 27 881 C2). These foreign substances can be organic compounds which can react in the electrolyte to form cation-active or amphoteric substances with organic anions. The anion supply substances can include alkylsulfates or sulfonic acids or arylsulfates or sulfonic acid in addition to alkyl or arylsulfates sulfonic acids.

To obtain a brightening effect in conjunction with the antiglare effect, the electrolyte additionally could contain known primary and/or secondary brighteners. These organic compounds provide a decoratively useful antiglare effect in the form of a matte finish for certain production periods. After a certain time interval, however, these foreign substances must be filtered out to avoid agglomeration. This is expensive. As a result of the filtering of the agglomerates and the materials which tend to agglomerate from the solution, during the next working cycle the organic foreign substances must be formed anew which is comparatively expensive.

OBJECTS OF THE INVENTION

It is, therefore, the principal object of the present invention to provide a process of the aforedescribed type whereby the drawbacks are obviated and improved and highly reproducible results are obtained.

It is a more specific object of the invention to provide an antiglare but relatively bright nickel coating by electrodeposition with improved antidazzling effects.

SUMMARY OF THE INVENTION

These objects and others which will become apparent hereinafter are attained, in accordance with the invention in a process for the galvanic deposition of glare-free nickel deposits on a metallic surface which is characterized by the following features:

1. The electrolyte or electrolytic bath which is used is a Watts electrolyte, a nickel plating sulfamate electrolyte, a nickel plating sulfomate electrolyte, a nickel plating fluorobate electrolyte or mixtures thereof, the electroplating bath containing one or more customary base brighteners.

2. To generate the glare-free nickel deposit, substituted and/or unsubstituted ethyleneoxide adducts or propyleneoxide adducts or ethyleneoxide-propyleneoxide adducts are used and are added to the electroplating bath.

3. The concentration of the adducts added at (2) is maintained in the range of greater than zero to less than 5 mg/l.

4. The electroplating is carried out with the electrolyte at a temperature maintained in the range of 40 to 75° C.

Finally, and critical to the invention, is the step of controlling the concentration in (3) and the temperature in (4) so that with the working bath the electrolyte appears to be clear on visual inspection to the naked eye and so a diffuse scattering of incident light is not seen. The term electrolyte is here used interchangeably with the term electrolytic bath.

More particularly, a method of electrodepositing a glare-free nickel coating upon a metallic surface of a substrate can comprise:

(a) electroplating nickel onto a metallic surface of a substrate from an electroplating bath selected from the group which consists of Watts, sulfamate, sulfonate and fluoroborate nickel-plating electrolytes and mixtures thereof containing a basic brightener;

(b) adding to the bath an amount of at least one antidazzle compound selected from the group which consists of substituted and unsubstituted ethylene-oxide adducts, propylene-oxide adducts and ethyleneoxide-propyleneoxide adducts in an amount sufficient to render the deposited nickel glare-free;

(c) maintaining a concentration of the antidazzle compounds in the bath to a range greater than zero and up to 5 mg/l;

(d) maintaining a temperature of the bath during electroplating in step (a) in a range between 40° and 75° C.; and (e) controlling the concentration in step (c) and the temperature in step (d) so that the bath during electroplating appears clear to the eye upon visual inspection and so that the bath shows practically no diffuse scattering of light incident upon the bath.

The electrolyte can be, for example, a Watts-type electrolyte consisting essentially of:

70 to 140 g/l nickel, 1 to 20 g/l chloride, 30 to 50 g/l $H_3BO_3$, and balance water, the antidazzle compounds and the brightener.

The brightener is preferably selected form the group which consists of 2-sulfobenzoic acid imide, 1,3-benzenedisulfonic acid, and napthalenetrisulfonic acid and alkali metal salts and mixtures thereof, and arylsulfonic acids, alkylsulfonic acids, sulfonamides and sulfonimides and alkali metal salts and mixtures thereof.

For generating a glare-free nickel deposit in a preferred embodiment of the invention, at least one substance of the group which consists of unsaturated aliphatic sulfonic acids or either alkali metal salts or mixtures thereof is used, preferably in an amount of 0.5 to 10 g/l.

Most preferably, the electroplating of the nickel from the electrolyte is carried out at a temperature in the range of 50 to 65° C. and the electrolyte can also contain wetting agents or surfactants and organic sulfonic acids or other alkali metal salts.

The invention is based upon our discovery that even without visible cloudiness of the bath and, therefore, without a visible emulsion and the need heretofore found to be important of organic foreign materials in the electrolyte, a high quality antidazzle effect can be attained following the teachings of the invention. The nickel layer produced in accordance with the invention has an entirely different structure than those produced by prior art processes as will be clarified further below in connection with the specific examples.

In spite of the lack of visible cloudiness in the bath itself, the precipitation of droplets may still occur with the system of the invention but these droplets appear to be stabilized by surface tension effects at the surface at which the deposit is formed so that the net effect is a high quality of reproducible glare-free deposit. Particularly surprising is the fact that detrimental agglomerates which might interfere with the antiglare effect and must be filtered off are not observed so that a bypass circulation is not only unnecessary but is not used at all.

The current density can be selected to suit the particular electrodeposition conditions but preferably ranges from 0.1 to 10 A/dm$^2$ according to the invention. Most preferably a current density of about 4 A/dm$^2$ is used.

The deposition time is largely optional and can be selected to suit the desired conditions and particularly the layer thickness. Preferably, however, the nickel electrodeposition is carried out for 1 to 120 minutes and most advantageously for about 10 minutes. When reference is made herein to a bypass circulation-free operation, we mean to indicate that there is no need to conduct the electrolyte or bath through a filtering device or a cooling device in the practice of the invention.

BRIEF DESCRIPTION OF THE DRAWING

The above and other objects, features, and advantages will become more readily apparent from the following description, reference being made to the accompanying drawing in which.

SPECIFIC DESCRIPTION

EXAMPLE 1

Figure 1:
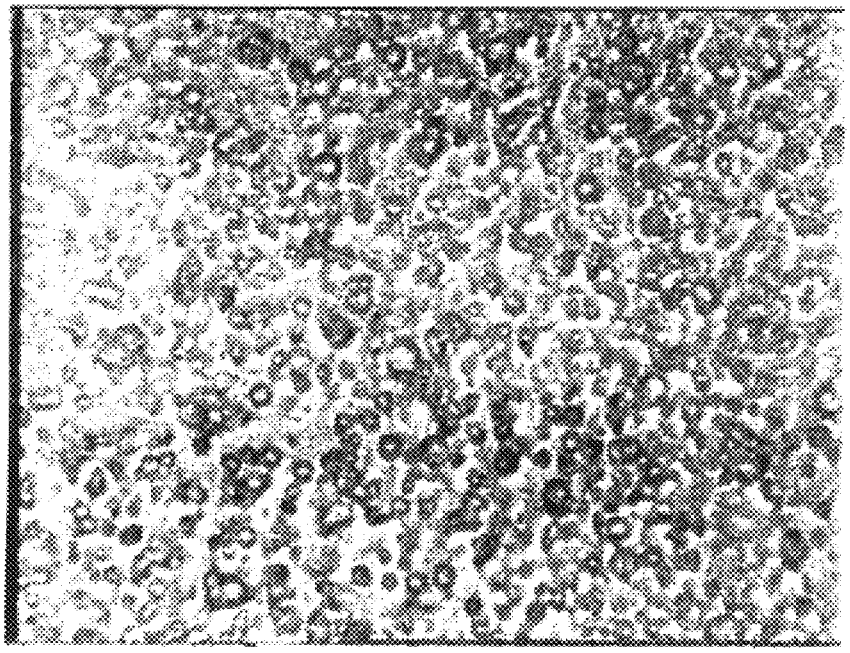
FIG. 1 is a photomicrograph of a surface of a nickel coating produced in accordance with Example 1 of the invention in an enlargement of 1 to 600.

A glare-free nickel coating is electroplated from an electrolyte consisting essentially of:

550 g/l $NiSo_4.7\ H_2O$ 50 g/l $NiCl_2.6\ H_2O$ 40 g/l $H_3BO_3$, to which 2.6 g/l of the sodium salt of benzoicacidsulfonimide, 1.8 g/l 2-propenesulfonate sodium salt and 1.5 mg/l of polyethyleneglycolmethylether (molecular weight of about 5000) are added, the balance being water. The electrolyte at a pH of 3.8 to 4.4 and a temperature at 55° C. and visually clear is used for the electroplating at 5 A/dm$^2$ for a period of 10 minutes with slight movement of the nickel-plated article, namely, a brass sheet. The low-glare nickel coating has the metallic effect shown in FIG. 1 with an enlargement of 1 to 600, this Figure showing a deposit with a droplet structure of which the droplet diameters being about 1 to 7 $\mu$m.

EXAMPLE 2 (COMPARATIVE)

Figure 2:
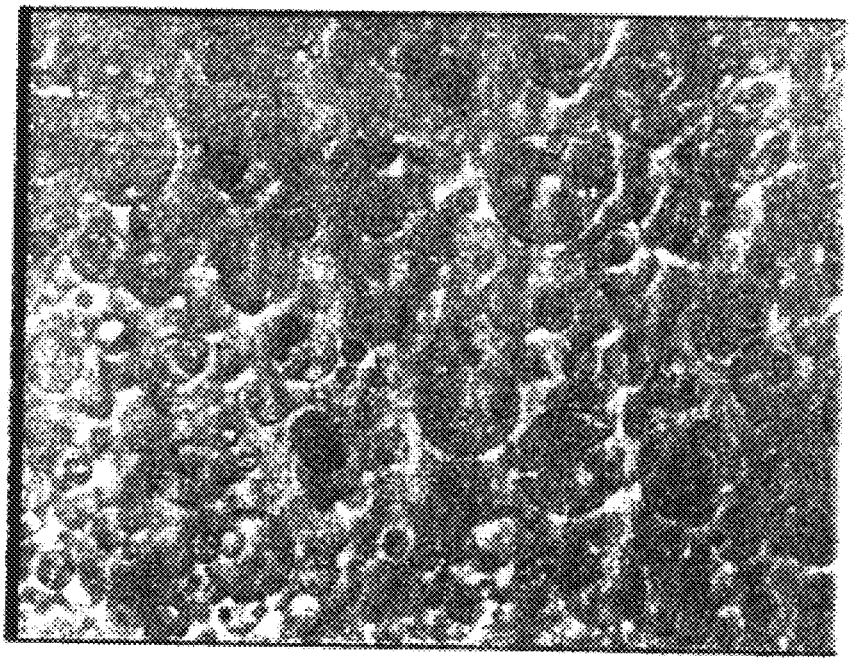
FIG. 2 is a photomicrograph showing a nickel deposit made utilizing the method of Example 2 also in the same enlargement.

A glare-free nickel deposit is formed using an electrolyte of the following composition:

265 g/l $NiSo_4.7\ H_2O$ 53 g/l $NiCl_2.6\ H_2O$ 33 g/l $H_3BO_3$, to which 1 g/l of the sodium salt of benzoic acid sulfonamide and 30 mg/l of propyleneoxide-ethyleneoxide block polymer (molecular weight about 2500) are added, the balance being water. The electroplating is carried out at a pH of the bath of 4.2 to 4.4 at a temperature of 52° C. and a current density of 5 A/dm$^2$ for a period of 10 minutes on a brass sheet with slight movement of the substrate. The low-glare nickel deposit has a satiny finish and is illustrated in the microphotograph of FIG. 2 at the same enlargement as that of FIG. 1. The deposit is in the form of a droplet structure with the droplet diameters ranging from 5 to 20 $\mu$m.

The cloudy electrolyte in Example 2 requires circulation through a filter to remove agglomerates and the deposit from Example 1 can be considered a significant improvement over the deposit of Example 2.

We claim:

1. A method of electrodepositing a glare-free nickel coating upon a metallic surface of a substrate, said method consisting essentially of the steps of:

(a) electroplating nickel onto a metallic surface of a substrate from an electroplating bath selected from the group which consists of Watts, sulfamate, sulfonate and fluoroborate nickel-plating electrolytes and mixtures thereof containing a basic brightener;

(b) adding to said bath an amount of at least one antidazzle compound selected from the group which consists of substituted and unsubstituted ethylene-oxide adducts, propyleneoxide adducts and ethyleneoxide-propyleneoxide adducts in an amount sufficient to render the deposited nickel glare-free;

(c) maintaining a concentration of said antidazzle compounds in said bath to a range greater than zero and less than to 5 mg/l;

(d) maintaining a temperature of said bath during electroplating in step (a) in a range between 40° and 75° C.; and (e) controlling said concentration in step (c) and said temperature in step (d) so that said bath during electroplating appears clear to the eye upon visual inspection and so that the bath shows practically no diffuse scattering of light incident upon said bath.

2. The method defined in claim 1 wherein said bath is a Watts electrolyte consisting essentially of:

70 to 140 g/l nickel, 1 to 20 g/l chloride, 30 to 50 g/l $H_3BO_3$, and balance water, said antidazzle compounds and said brightener.

3. The method defined in claim 2 wherein said brightener is selected from the group which consists of 2-sulfobenzoic acid imide, 1,3-benzenedisulfonic acid, and napthalenetrisulfonic acid and alkali metal salts and mixtures thereof, and arylsulfonic acids, alkylsulfonic acids, sulfonamides and sulfonimides and alkali metal salts and mixtures thereof.

4. The method defined in claim 3 wherein said brightener is present in said bath in an amount of 0.5 to 10 g/l.

5. The method defined in claim 2 wherein said brightener is at least one unsaturated aliphatic sulfonic acid or an alkali metal salt thereof.

6. The method defined in claim 5 wherein said temperature is 50° to 65° C.

7. The method defined in claim 6 wherein the electroplating in step (a) is carried out with a current density of 0.1 to 10 $A/dm^2$.

8. The method defined in claim 7 wherein the current density is about 4 $A/dm^2$.

9. The method defined in claim 8 wherein the electroplating in step (a) is carried out for a period of 1 to 120 minutes.

10. The method defined in claim 9 wherein the electroplating in step (a) is carried out for a period of about 10 minutes.

11. The method defined in claim 10 wherein said electroplating in step (a) is carried out with a bypass-circulation-free bath.

12. The method defined in claim 1 wherein said brightener is selected from the group which consists of 2-sulfobenzoic acid imide, 1,3-benzenedisulfonic acid, and napthalenetrisulfonic acid and alkali metal salts and mixtures thereof, and arylsulfonic acids, alkylsulfonic acids, sulfonamides and sulfonimides and alkali metal salts and mixtures thereof.

13. The method defined in claim 1 wherein said brightener is present in said bath in an amount of 0.5 to 10 g/l.

14. The method defined in claim 1 wherein said brightener is at least one unsaturated aliphatic sulfonic acid or an alkali metal salt thereof.

15. The method defined in claim 1 wherein said temperature is 50° to 65° C.

16. The method defined in claim 1 wherein the electroplating in step (a) is carried out with a current density of 0.1 to 10 $A/dm^2$.

17. The method defined in claim 16 wherein the current density is about 4 $A/dm^2$.

18. The method defined in claim 1 wherein the electroplating in step (a) is carried out for a period of 1 to 120 minutes.

19. The method defined in claim 18 wherein the electroplating in step (a) is carried out for a period of about 10 minutes.

20. The method defined in claim 1 wherein said electroplating in step (a) is carried out with a bypass-circulation-free bath.

21. A method of electrodepositing a glare-free nickel coating upon a metallic surface of a substrate, said method consisting essentially of the steps of:

(a) electroplating nickel onto a metallic surface of a substrate from an electroplating bath selected from the group which consists of Watts, sulfamate, sulfonate and fluoroborate nickel-plating electrolytes and mixtures thereof containing a basic brightener;

(b) adding to said bath an amount of at least one antidazzle compound which is a polyethyleneglycol methyl ether in an amount sufficient to render the deposited nickel glare-free;

(c) maintaining a concentration of said antidazzle compounds in said bath to a range greater than zero and less than 5 mg/l;

(d) maintaining a temperature of said bath during electroplating in step (a) in a range between 40° and 75° C.; and (e) controlling said concentration in step (c) and said temperature in step (d) so that said bath during electroplating appears clear to the eye upon visual inspection and so that the bath shows practically no diffuse scattering of light incident upon said bath.

22. The method of electroplating a glare-free nickel coating defined in claim 21 wherein the anti-dazzle compound is a polyethylene glycol methyl ether having a molecular weight of about 5000.

23. The method of electroplating a glare-free nickel coating defined in claim 21 wherein the anti-dazzle compound is added to the electroplating bath in an amount of about 1.5 mg/l.

24. A method of electrodepositing a glare-free nickel coating upon a metallic surface of a substrate, said method consisting essentially of the steps of:

(a) electroplating nickel onto a metallic surface of a substrate from an electroplating bath selected from the group which consists of Watts, sulfamate, sulfonate and fluoroborate nickel-plating electrolytes and mixtures thereof containing the sodium salt of benzoic acid as a basic brightener and 2-propenesulfonate sodium salt as a secondary brightener;

(b) adding to said bath an amount of at least one antidazzle compound which is a polyethyleneglycol methyl ether having a molecular weight of about 5000 in an amount sufficient to render the deposited nickel glare-free;

(c) maintaining a concentration of said antidazzle compounds in said bath to a range greater than zero and up to 1.5 mg/l;

(d) maintaining a temperature of said bath during electroplating in step (a) in a range between 50° and 65° C.; and (e) controlling said concentration in step (c) and said temperature in step (d) so that said bath during electroplating appears clear to the eye upon visual inspection and so that the bath shows practically no diffuse scattering of light incident upon said bath.

* * * * *